US006887328B1

(12) United States Patent
Smith et al.

(10) Patent No.: US 6,887,328 B1
(45) Date of Patent: May 3, 2005

(54) INDUCTION SPLICING OF PHOTOGRAPHIC FILM STRIPS

(75) Inventors: Thomas M. Smith, Spencerport, NY (US); Brian H. Johnston, Pittsford, NY (US); Narasimharao Dontula, Rochester, NY (US); Luba Kordovski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/716,158

(22) Filed: Nov. 18, 2003

(51) Int. Cl.[7] ..... B65H 69/06
(52) U.S. Cl. ..... 156/157; 156/273.9; 428/57
(58) Field of Search ..... 156/157, 159, 156/273.9; 428/57, 58

(56) References Cited

U.S. PATENT DOCUMENTS

| | | | | | |
|---|---|---|---|---|---|
| 2,577,570 | A | | 12/1951 | Eisenberg | |
| 3,148,185 | A | * | 9/1964 | Bowers et al. | 540/12 |
| 3,574,037 | A | | 4/1971 | Deans et al. | |
| 3,589,959 | A | | 6/1971 | Sander et al. | |
| 3,700,532 | A | | 10/1972 | Pierson | |
| 3,996,402 | A | * | 12/1976 | Sindt | 428/140 |
| 4,027,435 | A | | 6/1977 | Malloy | |
| 4,029,538 | A | | 6/1977 | Vance, Jr. | |
| 4,029,837 | A | * | 6/1977 | Leatherman | 442/16 |
| 5,770,296 | A | * | 6/1998 | Remerowski et al. | 428/80 |
| 6,639,197 | B2 | * | 10/2003 | Riess et al. | 219/633 |
| 2002/0031644 | A1 | * | 3/2002 | Malofsky et al. | 428/131 |
| 2004/0091694 | A1 | * | 5/2004 | Holzer et al. | 428/323 |

FOREIGN PATENT DOCUMENTS

| | | |
|---|---|---|
| EP | 0 497 393 | 8/1992 |
| EP | 0 919 151 | 6/1999 |
| JP | 55-119652 | 9/1980 |
| JP | 57-072816 | 5/1982 |
| JP | 57-073064 | 5/1982 |
| JP | 59-076220 | 5/1984 |
| JP | 62-098307 | 5/1987 |
| JP | 63-182610 | 7/1988 |
| JP | 04-019139 | 1/1992 |
| JP | 07-069369 | 3/1995 |
| JP | 10-000683 | 1/1998 |
| JP | 2001-047511 | 2/2001 |

* cited by examiner

*Primary Examiner*—Mark A. Osele
(74) *Attorney, Agent, or Firm*—Andrew J. Anderson

(57) ABSTRACT

A method is described for splicing together overlapping ends of first and second lengths of photographic film strips of common film strip width, comprising positioning a bonding element between an overlapping end of the first length of photographic film and a corresponding overlapped end of the second length of photographic film, and heating the bonding element to effect an adhesive bond between such film ends, wherein the bonding element comprises an induction heating receptive support and thermoplastic adhesive layers on each side of the support, and wherein the heating of the bonding element is performed by induction heating. The present invention allows for the preparation of photographic film splices, consisting of either homogeneous or dissimilar film bases, using a bonding element and induction heating to provide smooth yet strong splices. In particular, the invention enables successful splicing of acetate support (e.g., cellulose triacetate (CTA)) based films and polyester support (e.g., polyethylene terephthalate (PET)) based films either to themselves or each other. The invention provides a method of forming composite rolls of motion picture film containing different film bases as well as eliminating the need for emulsion skiving, and the use of toxic, flammable film cements when splicing CTA films.

17 Claims, No Drawings

INDUCTION SPLICING OF PHOTOGRAPHIC FILM STRIPS

FIELD OF THE INVENTION

This invention relates to a method of utilizing induction-heating technology to splice together photographic film strips, and especially motion picture films having dissimilar polymeric supports. In particular, the invention relates to materials and methods that will allow successful splicing of acetate support (e.g., cellulose triacetate (CTA)) based films and polyester support (e.g., polyethylene terephthalate (PET)) based films either to themselves or to each other.

BACKGROUND OF THE INVENTION

Motion picture photographic films used in producing a release print (the film projected in movie theaters) include camera origination film, intermediate film, and the release print film. Current practice for most motion picture production involves the use of at least four photographic steps. The first step is the recording of the scene onto a camera negative photographic film. While the original negative (typically after editing) may be printed directly onto a negative working print film in a second step to produce a direct release print, most motion picture productions use an additional two intermediate steps. Typically, the original camera negative film is printed onto a negative working intermediate film, such as Eastman Color Intermediate Film, yielding a master positive. The master positive is subsequently printed again onto an intermediate film providing a duplicate negative. Finally, the duplicate negative is printed onto a print film forming the release print. In practice, several duplicate negative copies are produced from the master positive, and each of the duplicate negatives may then be used to make hundreds of print film copies. This multistep process helps save the integrity of the valuable original camera negative film in preparing multiple release prints. In certain situations, usually involving special effects, intermediate film may be used an additional two or more times in preparing the final duplicate negatives to be used in printing the release prints. In this case, the first duplicate negative is used to print onto intermediate film to produce a second master positive, which is in turn used to produce a second duplicate negative. The second duplicate negative may be then used for printing the release prints.

The wide variety of potential film products available for the above-mentioned processes can be produced on either of two commonly employed polymeric supports: cellulose triacetate (CTA) and polyethylene terephthalate (PET). It is becoming more common for specific film codes to be available on only one of these supports as opposed to either. Currently, acetate-based films, and the older, less common cellulose nitrate-based films, are spliced to themselves using film cements comprising organic solvents designed to partially solubilize the cellulose-based film supports. Satisfactory cement splicing requires careful scraping away of the emulsion layers of the lower film component prior to application of the film cement in order to allow intimate support contact. It is also important to allow sufficient clamping time in the splicer. Current recommendations are fifteen to thirty seconds under modest heat and pressure prior to handling of the splice. Because a cement splice does not attain fill strength for several hours, care is required when handling the film if immediate use is contemplated. Not only is this splicing technique cumbersome, time consuming, and a source of debris, but there are also health, safety and environmental concerns surrounding the components of the currently employed film cements.

With the advent of PET-based film products, a new splicing technique was required since this film support does not readily lend itself to cement splicing. The polymer used as the support base is not soluble in the solvents used in film cement and even more toxic solvents would be required to produce the same type of bonding with PET-based films. The most common method of splicing PET-based film, when it was originally introduced, was the use of pressure sensitive tapes. These tapes are costly, cumbersome, a potential source of dirt and require application to imaged frames adjacent to the splice itself.

A more convenient method of splicing PET-based films has been with the use of ultrasonic energy to essentially "weld" the two film members together. This splicing technique is typically accomplished in an overlap configuration, and within an area that will exclude perforations and/or an imaged frame. U.S. Pat. Nos. 3,574,037 and 4,029,538, and EP 0497 393, e.g., describe systems and apparatus employing the use of ultrasonic sealing devices that can be used to splice films, specifically motion picture films. These patents, however, refer only to the splicing or welding of polyester-based film products.

While the use of ultrasonic welding techniques has been suggested for splicing of acetate based film strips, attempts to do so have generally not been successful. Motion picture film splicers that have been developed which utilize ultrasonic energy to splice PET-based films together, e.g., when used to splice CTA-based films cause brittleness and diminished strength typically resulting in splices that are far too weak and/or rough for practical application. Such splices may exhibit levels of roughness that are likely to damage adjacent areas of film when wound in roll form. Additionally, the increased thickness produced by the molten acetate material may prevent splices from smooth conveyance through the tight tolerances encountered in film printing gates. Similarly, using existing ultrasonic splicing devices to join CTA and PET film stocks produces the same rough, distorted surface of the acetate film member. U.S. Pat. No. 3,700,532, e.g., notes some typical problems associated with attempts to ultrasonically splice acetate based film strips.

Japanese Kokais 57-072816 A and 57-073064 A describe materials that can be utilized to bond components using induction heating. These consist of thermoplastic resins coated on both sides of metallic films. These publications, however, refer only to the bonding media itself and not the adherends.

Japanese Kokai 55-119652 A teaches a method of splicing together photographic paper using induction heating. Overlapped sections of photographic paper webs are joined together by preheating the surfaces, prepressing and then induction heating under pressure to form a splice. This application relies on the thermal fusing of resin-coated paper to itself and not the bonding of photographic film products of differing polymeric composition.

Similarly there are numerous patent publications, among them Japanese Kokais 62-098307 A and 63-182610 A, that deal with the splicing together of optical fibers by means of induction heating. Again, the splice components are of homogeneous composition and the application is non-photographic.

There are also many patent publications, typified by Japanese Kokais 04-019139 A and 07-069369 A, that teach this technology for the use of lidding attachment in the bottling industry. The two patents referenced involve the use of an aluminum foil layer or similar electrically conducting support, coated on one surface with a thermoplastic resin layer having good adhesion to the container material.

There are numerous other patent publications that describe the use of 10 induction heating to bond various materials together. They range from bonding together shoe components (EP 0 919 151 A1), to the assembly of automotive panels (Japanese Kokai 59-076220 A), to the attachment of labels to metallic can bodies (Japanese Kokais 10-000683 A and 2001-047511 A).

To date no one has provided a method for successfully splicing together motion picture film strips composed of dissimilar polymeric supports that does not rely on the use of pressure-sensitive tape. The prior art has also failed to provide a method of splicing cellulosic-based motion picture film without the need for removal of the emulsion layer and application of a flammable and toxic solvent mixture.

SUMMARY OF THE INVENTION

In accordance with one embodiment of the invention, a method is described for splicing together overlapping ends of first and second lengths of photographic film strips of common film strip width, comprising positioning a bonding element between an overlapping end of the first length of photographic film and a corresponding overlapped end of the second length of photographic film, and heating the bonding element to effect an adhesive bond between such film ends, wherein the bonding element comprises an induction heating receptive support and thermoplastic adhesive layers on each side of the support, and wherein the heating of the bonding element is performed by induction heating.

The present invention allows for the preparation of photographic film splices, consisting of either homogeneous or dissimilar film bases, using a bonding element and induction heating to provide smooth yet strong splices. In particular, the invention enables successful splicing of acetate support (e.g., cellulose triacetate (CTA)) based films and polyester support (e.g., polyethylene terephthalate (PET)) based films either to themselves or each other. The invention provides a method of forming composite rolls of motion picture film containing different film bases as well as eliminating the need for emulsion skiving, and the use of toxic, flammable film cements when splicing CTA films.

DETAILED DESCRIPTION OF THE INVENTION

In accordance with this invention, materials and methods are identified that will allow induction heating devices to be used to splice either polyester-based films or acetate-based films either to themselves or to each other and provide an adequate level of splice strength and smoothness.

Induction bonding technology provides the capability of bonding incompatible substrates, at high sealing rates, with precise control over the bond area. By far the most common applications of induction heating technology to date have been directed towards food packaging and lidding materials. These technologies typically employ a heat-sealable thermoplastic adhesive layer on one side of a metal foil or metal coated (vacuum deposited) polymeric web. The present inventors have found that the induction heating process may be employed successfully for the splicing of photographic film strips, and in particular motion picture film strips, provided the adhesive is applied to both sides of an induction heating receptive support. The process of the invention is particularly advantageous in that it enables the splicing of dissimilar motion picture films, which has been particularly problematic in the art.

The key to induction heating bonding in accordance with the invention is incorporation of a bonding, element, which comprises an induction heating receptive (typically metallic) support and a thermoplastic adhesive layer on each side of the support. When placed between two substrates and exposed to the electromagnetic field of an induction coil, the bonding element generates sufficient heat to either bring the surrounding surfaces to fusion temperature or, sufficiently soften the adhesive material to allow it to bond the surrounding surfaces together.

Induction heating in accordance with the invention may be accomplished with use of a high power oscillator that supplies alternating current to an induction work coil. An alternating magnetic field is associated with the supplied current according to Ampere's law. The energy associated with the magnetic field is transferred to the bonding element by electromagnetic induction (Lenz's law and Faraday's law). One or both of the following phenomena therefore generate heat within the materials: hysteresis losses, whereby a magnetic material tends to oppose a change in or lag an applied oscillating field; and conduction losses, whereby electrical conductors resist the flow of electrons associated with an induced current (eddy currents).

Typically an electromagnetic field of 10 kHz to 15 MHz may be employed, more preferably the frequencies of 2 MHz to 6 MHz are employed. Low frequencies are typically employed for thicker materials where deep heat penetration is required, while higher frequencies are effective for smaller parts or shallower penetration. The induction-heating coil, typically comprising water-cooled copper tubing, is generally formed into different shapes depending on the application and to maximize the heating effect. One common shape that is used is a hairpin-shaped loop. The coil is usually embedded in a nonmetallic fixture that aligns the components with necessary pressure prior to bonding. The coil is placed in close proximity to the bonding element and power is pulsed to the unit, typically for a fraction of a second. Since induction heating is highly directional, very small bonding areas can be heated without affecting the surrounding areas. Furthermore, power input can be regulated to achieve the temperatures needed for bonding.

In accordance with a preferred embodiment of the invention, induction heating may be used for splicing together acetate-based film products with resultant strong and smooth splices. The ability to splice acetate-based film using induction heating eliminates the need for emulsion layer skiving as well as the use of flammable and toxic solvent cements. In addition, it provides the capability for joining together dissimilar film products. It also allows, e.g., for acetate-based film to be adequately spliced to polyester-based film products, which until now has been impossible without the use of pressure sensitive tape.

In accordance with the method of the invention, overlapping ends of first and second lengths of photographic film strips of common film strip width are spliced together by positioning a bonding element between an overlapping end of the first length of photographic film and a corresponding overlapped end of the second length of photographic film, and heating the bonding element to effect an adhesive bond between such film ends, wherein the bonding element comprises an induction heating receptive support and thermoplastic adhesive layers on each side of the support, and wherein the heating of the bonding element is performed by induction heating.

To enable effective splicing of motion picture film strips (typically having film widths of from 8 to 70 mm) having imaged scene frame areas without having the splice area negatively effect the imaged frame areas, in accordance with a preferred embodiment of the invention a bonding element is employed which is from 0.5 to 3 mm in width and from 8 to 70 mm in length and less than or equal to about 200 μm thick, and the bonding element is positioned lengthwise across the film strip width in an area between the imaged scene frame areas.

The bonding element preferably has a thickness of from about 5 μm to about 100 μm, more preferably from about 5 μm to about 50 μm, and even more preferably from about 5 μm to about 30 μm, in order to minimize thickness of the resulting spliced area.

In accordance with a particular embodiment, the bonding element employed in the process of the invention may comprise a metal foil support having a thickness of from about 5 μm to about 100 μm (more preferably from about 10 μm to about 50 μm, and even more preferably from about 10 μm to about 25 μm) and thermoplastic adhesive layers of from about 1 to about 20 μm (more preferably from about 1 to about 10 μm) coated on each side of the support. The metal foil support may comprise any induction heating receptive metal, although aluminum foil is preferred for balance of cost and performance.

Alternatively, the induction heating receptive support of the bonding element may comprise a polymeric film support with layers of electrically conductive or magnetic metal vacuum-deposited on both surfaces of the polymeric film. Polymeric supports in accordance with such embodiment preferably may comprise, e.g., polyethylene terephthalate film having a thickness of from about 5 μm to about 50 μm (more preferably from about 6 μm to about 20 μm). Each vacuum-deposited metal layer in such embodiment preferably has a thickness of from about 1000 to about 8000 Angstroms (more preferably from about 4000 to about 6000 Angstroms), with silver being an example of a preferred deposited metal layer.

Two coatable thermoplastic adhesive materials, which have been identified as superior for use in bonding elements for use in the method of the invention, include VITEL™ 3300B, produced by Bostik and HYPALON™ 30, from DuPont Dow Elastomers. HYPALON™ 30 is a chlorosulfonated polyethylene resin having a molecular weight (N) of 23,000. The polymer contains 43% (by weight) chlorine and 1.1% (by weight) sulfur. It has a glass transition temperature of 10°C, and is soluble in aromatic and chlorinated hydrocarbons, esters, and ketones. VITEL™ 3300B is a high molecular weight, aromatic, linear saturated polyester resin having a glass transition temperature of 11° C. and a (Ring and Ball) melt flow point of 125° C. This is a typically employed thermoplastic adhesive material with a suggested activation temperature of at least 27° C. It is most soluble in oxygenated solvents such as ketones and esters.

In a further embodiment of the invention, the adhesive layers may comprise pre-formed adhesive films that are laminated to both sides of the induction heating receptive support, in particular where the support comprises a metal foil. The pre-formed adhesive films preferably comprise self-supported adhesive films of less than or equal to about 50 μm in thickness, more preferably less than or equal to about 25 μm in thickness, having a thermal activation temperature of greater than 75° C., an ultimate elongation of less than 400%, and a 2% secant modulus of less than 120 $N/mm^2$. Examples of such preferred pre-formed adhesive films include INTEGRAL™ 709 and INTEGRAL™ 803 films available from Dow Chemical Company.

EXAMPLES

The following examples are intended to illustrate the present invention more practically but not to limit it in scope in any way.

Film materials used to evaluate the effectiveness of induction heating splicing represent a cross-section of Eastman Kodak motion picture film products on both acetate and polyester base. All films tested were unexposed, processed, 35 mm products. The specific (EK) film codes and brief description are listed below:

2234—a polyester-based panchromatic negative film intended for making duplicate negatives from master positives, or internegatives from reversal originals.

5234—an acetate-based version of 2234.

2383—a polyester-based color print film.

5279—an acetate-based color negative film.

Six-inch lengths of film were spliced together in various combinations with various bonding elements and tested for tensile strength, peel strength, and surface roughness on the spliced area. The induction heating process utilized a system comprised of a NOVA STAR™ 3L solid state induction power supply, a water-cooled chilling unit, and a remote heating (sealing) station which includes a coil mounted in a non-conductive clamping fixture. The NOVA STAR™ unit has a frequency of 485 kHz, 3 kW power, and was used in conjunction with a water-cooled single loop (hairpin) copper coil mounted in a TEFLON™ bed. A second TEFLON™ bar provided clamping pressure and held the film components in place over the coil using air pressure. Unless otherwise indicated, all bonding/splicing was carried out using an impulse time of 0.5 seconds at a 70% power level and approximately 140 kPa of clamping pressure.

Tensile strength was measured by separation of the splice sample on an Instron Tensile Tester (model 4301) at a separation rate of 30 cm/min, at 22° C. and 60% RH. Five replicate samples were tested and the average reported.

Peel strength was measured on splices prepared with one film member directly on top of the second member (as opposed to an overlap splice), and separated in a "wishbone" configuration at a separation rate of 30 cm/min. This testing was also done at 22° C. and 60% RH. Five replicate samples were tested and the average reported.

Surface roughness was measured using a Taylor Hobson profilometer, by tracing across the leading and trailing edges of a splice, perpendicular to the film width, and approximately 5 mm in from the outside edges of the film. Roughness was reported as the standard deviation of the height of the traced surface, in micrometers. Roughness values reported represent the average of the leading and trailing trace values.

Based on current splicing technology and discussions with potential users, it is felt that a tensile strength of greater than 15 kg and peel strength of greater than 1.0 kg, coupled with a surface roughness of less than 35 μm should be sufficient for all splicing applications. These values were established as aims for acceptable use.

As a means of comparison, cement splices were prepared using 5234 acetate-based film. Cement splicing was done on a Maier-Hancock, model 1635, splicer. The emulsion layer was scraped away for the preparation of all splices and they were made with Kodak Film Cement. Film cement splices were clamped for thirty seconds with a splicing block temperature of approximately 43° C. and tested no sooner than thirty minutes after being made.

Comparison is also made to splices comprising 2234 polyester-based film made on a Model 3001 ultrasonic film splicer from Metric Splicer & Film Company, Inc. There was no scraping or removal of emulsion or backing layers prior to ultrasonic splicing.

Example 1

A bonding element was prepared by coating thermoplastic adhesive material (VITEL™ 3300B, produced by Bostik) onto each side of standard food-grade aluminum foil from Alcoa (REYNOLDS WRAP™), which is approximately 18 μm in thickness. VITEL™ 3300B is a high molecular weight, aromatic, linear saturated polyester resin having a glass transition temperature of 11° C. and a (Ring and Ball) melt flow point of 125° C. The adhesive was applied from a 30% solution in 2-butanone. The coatings were dried for 15 minutes at 65° C. Dried coating thickness was estimated to be approximately 61 μm on either side of the foil.

Pieces of coated foil were cut 2 mm wide by 35 mm long to form film strip bonding elements, and sandwiched between overlapping ends of strips of 5234 and 2234 films. Splices were prepared by positioning the bonding element internal to the overlapped film components, clamping the assembly directly over an induction coil, initiating the sealing cycle (0.5 seconds impulse at 70% power), and then releasing the pressure and removing the splice. The induction heating sealed spliced samples have an average peel strength of 1.6 kg/35 mm width.

Comparison cement splices made with 5234 acetate film averaged 1.5 kg/35 mm width, and comparison ultrasonic splices made with 2234 polyester film averaged 5.2 kg/35 mm width. Both the cement splice and ultrasonic splice resulted in film tearing at the reported values. Due to the fact the induction splices are equivalent to cement splices, they should be adequate for practical application.

Example 2

Splice samples were prepared similarly as in Example 1 using different films, film combinations, and orientations and measured for tensile strength. The bonding element and sealing parameters are the same as noted in Example 1. The resulting tensile strength averages are shown in Table 1. In Table 1, the film listed first is the upper member of the splice; therefore the backside of this film is bonded to the emulsion side of the lower film member.

TABLE 1

| Film codes | Tensil Strength (kg) |
|---|---|
| 2383/2383 | 12.8 |
| 5279/5279 | 13.3 |
| 2383/5279 | 10.0 |

TABLE 1-continued

| Film codes | Tensil Strength (kg) |
|---|---|
| 5279/2383 | 18.5 |
| 2234/2234 | 12.5 |
| 5234/5234 | 11.5 |
| 2234/5234 | 11.7 |
| 5234/2234 | 10.8 |
| Aim | 15.0 |
| 5234 Cement check | 13.6 |
| 2234 Ultrasonic check | 10.4 |

Most of the combinations, independent of film type or orientation, exhibit a tensile strength of 10–13 kilograms, which is comparable to the ultrasonic and cement splice checks and therefore considered adequate for practical application. It is demonstrated that similar or dissimilar films can be spliced in any configuration or orientation and maintain a level of strength comparable to existing splices.

Example 3

VITEL™ 3300B adhesive was applied to a polyethylene terephthalate (PET) support that had been vacuum-metalized with a thin layer of silver. The adhesive was coated on the silver surface at a dry thickness of approximately 6 μm. This material proved to be very receptive to induction heating, but at the impulse time and power levels previously employed (0.5 seconds and 70% respectively), the film has a tendency to char. For this sample only, the backside of 2234 acetate based film was bonded to a sample of the metal layer and adhesive coated PET support by induction heating similarly as in Example 1, but with the power reduced to 30% and the impulse time increased to 2.0 seconds. The peel strength of the adhesive coated surface to the backside of 2234 film averaged 4 kg/35 mm width, well above the aim strength.

Example 4

A series of adhesive films from the Dow Chemical Company, under the trade name INTEGRAL™, were evaluated for potential application. Each film represents a different proprietary adhesive material. Some are cast in a single layer and others are co-extruded films of two different adhesive layers. Each film was laminated to both sides of aluminum foil, having a thickness of 25 μm using a double-heated nip laminator. Roll temperatures of 150° C. were used with a web speed of 30 cm/min under light nip pressure. The materials prepared in this fashion were cut into 2 mm by 35 mm pieces and sandwiched between 2383 filmstrips. Induction heating splice sealing was accomplished similarly as in Example 1, at 0.5 seconds impulse time using 70% power. A list of the adhesive films tested, along with select physical properties, and the resultant peel and tensile strengths of the splice, are shown in Table 2.

TABLE 2

| | Adhesive Film | | | | | |
|---|---|---|---|---|---|---|
| Type | INTEGRAL 115 single layer | INTEGRAL 709 single layer | INTEGRAL 801 single layer | INTEGRAL 803 coextruded | INTEGRAL 835 coextruded | INTEGRAL E100 coextruded |
| Thickness (um) | 25 | 50 | 25 | 25 | 50 | 25 |
| Activation Temp. (° C.) | 87 | 85 | 71 | 102 | 102 | 102 |
| Elongation (%) | 425 | 200 | 400 | 340 | 400 | 100 |
| 2% Secant Modulus (N/mm2) | 186 | 107 | 123 | 100 | 86 | 207 |
| Peel Strength (kg) | 0.2 | 1.2 | 0.7 | 1.4 | 0.3 | 0.7 |
| Tensile Strength (kg) | — | 26.2 | 13.9 | 19.4 | — | 16.8 |

For each film, the thickness indicated is the thinnest gauge that product is available in. The values for ultimate elongation and modulus have been measured in the machine direction according to ASTM procedure D 882. Both INTEGRAL™ 709 and INTEGRAL™ 803 are adequate candidates for this application. These two film adhesives have an activation temperature greater than 75° C. coupled with an elongation of less than 400% and a modulus of less than 120 $N/mm^2$.

Example 5

In order to minimize total thickness in the splice area, bonding elements were prepared similarly as in Example 4, but with INTEGRAL™ 803 film laminated to both sides of a 12.5 μm aluminum foil. The material prepared in this fashion was cut into 2 mm by 35 mm pieces and sandwiched between 2383 filmstrips, and the same laminating and splicing conditions as outlined above were used. The resulting peel strength averaged 1.0 kg/35 mm width and the tensile strength averaged 23.3 kg. Both strength aims are met and the total bonding element thickness is 62.5 μm.

Example 6

A sample consisting of 17.5 μm aluminum foil coated on both sides with a 2.5 μm coating of thermoplastic adhesive layer (total thickness of element 22.5 μm) was obtained from All-Foils, Inc. of Brooklyn Heights, Ohio. The proprietary adhesive, referred to as HSX 3, has a recommended activation temperature of 116° C. The material was cut into 2 mm by 35 mm pieces and inserted between strips of 2383 film. Induction heating sealing was done as described above at 70% power for 0.5 seconds impulse time. The strength of these splices and roughness of the splice area are listed in Table 3, along with ultrasonic splices made with 2383 as a comparison.

TABLE 3

| Splice | Peel Strength (kg) | Tensile Strength (kg) | Roughness (um) |
|---|---|---|---|
| Induction w/ HSX 3 | 1.0 | 16.1 | 9.3 |
| 2383 Ultrasonic Control | 3.3 | 28.0 | 18.3 |
| Aim | >1 | >15 | <35 |

As indicated the induction-formed splice meets the desired specifications established for strength and is considerably smoother than a typical ultrasonic control splice.

This invention has been described in detail with particular reference to certain preferred embodiments thereof, but it will be understood that variations and modifications can be effected within the spirit and scope of the invention.

What is claimed is:

1. A method for splicing together overlapping ends of first and second lengths of photographic film strips of common film strip width, comprising positioning a bonding element between an overlapping end of the first length of photographic film and a corresponding overlapped end of the second length of photographic film, and heating the bonding element to effect an adhesive bond between such film ends, wherein the bonding element comprises an induction heating receptive support and thermoplastic adhesive layers on each side of the support and wherein the heating of the bonding element is performed by induction heating, where the first and second lengths of photographic film strips are motion picture film strips of width from 8 to 70 mm, the film strips contain imaged scene frames, the bonding element is from 0.5 to 3 mm in width and from 8 to 70 mm in length and less than or equal to about 200 μm thick, and the bonding element is positioned lengthwise across the film strip width in an area between the imaged scene frame areas, and wherein the peel strength of the resulting prepared splice exceeds 1.0 kg/35 mm, width and the tensile strength of the resulting prepared splice exceeds 18 kg/35 mm width.

2. A method according to claim 1, wherein the bonding element has a thickness of from about 5 μm to about 100 μm.

3. A method according to claim 2, wherein the bonding element has a thickness of from about 5 μm to about 50 μm.

4. A method according to claim 1, wherein the bonding element has a thickness of from about 5 μm to about 30 μm.

5. A method according to claim 1, wherein the bonding element comprises a metal foil support having a thickness of from about 5 μm to about 100 μm and thermoplastic adhesive layers of from about 1 to about 10 μm coated on each side of the support.

6. A method according to claim 5, wherein the metal foil has a thickness of from about 10 m to about 50 μm.

7. A method according to claim 5, wherein the bonding element comprises a metal foil support having a thickness of from about 10 μm to about 25 μm and thermoplastic adhesive layers of from about 1 to about 5 μm coated on each side of the support.

8. A method according to claim 1, wherein the bonding element comprises a metal foil support having a thickness of from about 5 μm to about 100 μm and pre-formed adhesive films which are laminated to both sides of the metal foil.

9. A method according to claim 8, wherein the pre-formed adhesive films comprise self-supported adhesive films of less than or equal to about 50 μm in thickness having a thermal activation temperature of greater than 75° C., an ultimate elongation of less than 400%, and a 2% secant modulus of less than 120 $N/mm^2$.

10. A method according to claim 8, wherein the pre-formed adhesive films comprise self-supported adhesive films of less than or equal to about 25 μm in thickness having a thermal activation temperature of greater than 75° C., an ultimate elongation of less than 400%, and a 2% secant modulus of low mm 120 $N/mm^2$.

11. A method according to claim 1, wherein the metal foil comprises aluminum foil.

12. A method according to claim 1, wherein the induction heating receptive support of the bonding element comprises a polymeric film support with layers of electrically conductive or magnetic metal vacuum-deposited on both surfaces of the polymeric film.

13. A method according to claim 12, wherein the polymeric support comprises polyethylene terephthalate having a thickness of from about 5 μm to about 50 μm and each vacuum-deposited metal layer has a thickness of from about 1000 to about 8000 Angstroms.

14. A method according to claim 13, wherein the polymeric support has a thickness of from about 6 μm to about 20 μm and each vacuum-deposited metal layer has thickness of from about 4000 to about 6000 Angstroms.

15. A method according to claim 12, wherein the metal layers comprise silver.

16. A method according to claim 1, wherein the first and second lengths of photographic film strips each independently comprises an acetate based film strip or a polyester based film strip.

17. A method according to claim 1, wherein one of the first and second lengths of photographic film strips comprises an acetate based film strip and the other of the first and second lengths of photographic film strips comprises a polyester based film strip.

* * * * *